US006874286B2

(12) United States Patent
Tavivian

(10) Patent No.: US 6,874,286 B2
(45) Date of Patent: Apr. 5, 2005

(54) WINDOW FRAME CONSTRUCTION SYSTEM AND CONNECTOR UNITS FOR USE THEREIN

(75) Inventor: Aharon Tavivian, Omer (IL)

(73) Assignee: MTD Industries Ltd., Beer Sheva (IL)

( * ) Notice: Subject to any disclaimer, the term of this patent is extended or adjusted under 35 U.S.C. 154(b) by 333 days.

(21) Appl. No.: 10/221,027

(22) PCT Filed: Mar. 7, 2001

(86) PCT No.: PCT/IL01/00223

§ 371 (c)(1),
(2), (4) Date: Sep. 9, 2002

(87) PCT Pub. No.: WO01/66896

PCT Pub. Date: Sep. 13, 2001

(65) Prior Publication Data

US 2003/0046885 A1 Mar. 13, 2003

(30) Foreign Application Priority Data

Mar. 7, 2001 (IL) ..... 134931

(51) Int. Cl.[7] ..... E06B 1/60

(52) U.S. Cl. ..... 52/217; 52/204.56; 52/204.62; 52/204.7; 49/505

(58) Field of Search ..... 52/204.1, 204.62, 52/204.56, 212, 217, 204.55, 204.7; 49/505, 504, 404, 418

(56) References Cited

U.S. PATENT DOCUMENTS 1,754,762 A * 4/1930 Nelson ..... 52/204.56
2,595,506 A * 5/1952 Backman ..... 52/127.12
4,453,346 A * 6/1984 Powell et al. ..... 49/404
4,745,721 A * 5/1988 Gartner ..... 52/745.16
6,167,663 B1 * 1/2001 Nakamoto et al. ..... 52/217
6,502,356 B2 * 1/2003 Emek ..... 52/204.72
6,530,184 B1 * 3/2003 Emek ..... 52/204.591

FOREIGN PATENT DOCUMENTS

| | | | |
|---|---|---|---|
| DE | 1979532 U | | 2/1968 |
| EP | 0623728 A | | 11/1994 |
| FR | 1517369 A | | 6/1968 |
| IL | 116238 A | | 7/1998 |
| JP | 11-241569 | * | 9/1999 |
| NL | 7203174 A | | 9/1973 |

* cited by examiner

*Primary Examiner*—Winnie Yip
(74) *Attorney, Agent, or Firm*—Banner & Witcoff, Ltd.

(57) ABSTRACT

The invention provides a window frame construction system (10) comprising an inner frame (12), an apertureless outer frame (18) provided with at least abutment surface (22) projecting towards said inner frame (12) and a plurality of aligning connector units (26) for attaching said inner frame (12) inside said outer frame (18), said unit comprising, a hollow body (28) attachable to said inner frame (12), a nut plate (34) engageable with said inner frame (12) and having an internal screw thread (36) matching an externally screw-threaded portion of said hollow body (28), whereby said hollow body (28) may be adjusted to project a desired distance outwards from said inner frame (12) towards the outer frame (18), and a first rotatable member (40), insertable in a hollow body (28), wherein said first internal rotatable member (40) is provided with a projection (42), an end portion (44) of which faces outwards towards said outer frame (18) for effecting engagement and alignment between said inner and outer frames.

7 Claims, 2 Drawing Sheets

WINDOW FRAME CONSTRUCTION SYSTEM AND CONNECTOR UNITS FOR USE THEREIN

This application is a National Stage application of co-pending PCT application PCT/IL01/00223 filed Mar. 7, 2001, which was published in English under PCT Article 21(2) on Sep. 13, 2001, which claims the benefit of Israeli application Serial No. 134,931 filed Mar. 7, 2000.

The present invention relates to a window frame construction system and to connector units for constructional frames. More particularly, the invention provides means to firmly connect and align an inner frame of the type used, e.g., for windows, to an outer frame attached to a building, and especially to connect and align inner and outer metal frames.

The present invention is a modification of an improvement on the invention described and claimed in Israel Patent 116,238 the relevant teachings of which are incorporated herein by reference.

A common form of window construction in security rooms involves the preparation of "blind" or outer steel frames around which concrete is poured. After the concrete is set, an inner window frame of steel or aluminum is attached inside the outer steel frame. Both frames are suitably corrosion-protected. Any gaps between the two frames are filled by a sealant. Such sealant is, in most cases, not relied upon to retain the inner frame; screw fasteners are inserted through the inner frame and into the outer frame.

Some form of screw fastening is essential-for windows used in security rooms designed to survive the same blast pressure which can be resisted by the wall in which the window is held, typically 10,000 kg/m$^2$., which is equal to 1 bar. In such construction, the task of the sealant is the exclusion of dangerous gases, and such sealing encompasses the exclusion of moisture.

The use of standard screws might provide a satisfactory solution if the outer and inner frames fitted each other perfectly and if there were no space left between them. Due to construction and manufacturing inaccuracies, there is a need to leave such a space, part of which is utilized for alignment and adjustment in fitting the inner frame.

In order that the window will be well sealed against the inner frame, it is of particular importance to avoid distortion of said inner frame. Such distortion is certain to result when screws are used to hold the inner frame within an outer frame which was inaccurately made, or which became distorted during construction.

The problem of distortion has been overcome by a known connector unit in commercial use, which comprises a flanged, cylindrical plastic body having an externally screwed shoulder and a hexagonal-section bore. A plastic nut plate screws onto the screwed body. When assembled, the flange rests against the outer, blind steel frame, while the nut plate is retained in rails on the outside of the inner frame, which has smaller dimensions than the inside of the outer frame. The hexagon bore in the flanged cylindrical body is used to revolve said body and thereby to axially adjust the window unit outwards, as needed, to contact the blind frame. A hand-held drill is then inserted through the hexagonal bore and used to drill through the steel flange of the blind outer frame and into the concrete, and then a self-threading fastener is inserted into the drilled hole and tightened.

One of the difficulties inherent in the above-described method is that the type of drill and the drilling speed suitable for drilling steel are different from those suitable for drilling concrete. As is well-known, concrete should be drilled with a carbide-tipped drill, at slow speed, without lubricant. On the other hand, steel should be drilled with a high speed steel drill, driven at medium speed and with the use of a lubricant. A high speed steel drill used on concrete will soon be blunted, making subsequent drilling of steel difficult.

In any case, it is best to avoid drilling on site, as time spent drilling during construction is more costly than factory time. In addition, the need to supply electric power for drilling at every point at a building site where windows are being installed is also a source of potential accidents, due to the need to string long, flexible electric cables across the building.

Typically, a window frame intended to resist high blast forces is attached to a blind frame at 8 or 12 points. A large building, having 100 or more windows, may require over 1,000 attachments. The time and cost saved by a better method of attaching windows will therefore make a worthwhile contribution to meeting construction time and cost targets.

The above-described prior art system of drilling holes in blind outer frames at the building site and connecting inner frames thereto with standard screws and connectors, provides the necessary sealing connection between frames in a security room. However, this procedure requires precision and skilled workers. Furthermore, it involves difficult physical work, the use of professional tools, and the carrying out thereof is extremely time-consuming. For these reasons, this method of blind outer frames is not used today in conventional construction, since this method is too complicated, expensive and impractical for such conventional use.

The present invention is thus intended to obviate the above-described disadvantages of the prior art window frame attachment method, and to provide a system which eliminates the need for on-site drilling, allows speedy and safer installation of window frames, and reduces the cost of the assembled window.

It is a further object of the present invention to allow space take-up between the outer blind window frame and the inner frame, while ensuring that the inner frame remains undistorted after assembly.

A still further object of the present invention is to provide a window attachment system having the necessary strength specified for the construction of security rooms. A central feature of the standard for security rooms is that the window frames be secured to resist the high horizontal forces which result from a nearby explosion.

The system in units of the present invention can also be used to advantage in regular windows as well as in skyscrapers in which windows much resist the gust force of high velocity winds.

In Israel Patent 116,238 there is provided an aligning connector unit for attaching an inner frame inside an outer frame, said unit comprising a hollow body attachable to an inner frame, said hollow body having a first extremity and an opposite, second extremity, at least a portion of the outer surface of said hollow body, including said first extremity, being externally screw-threaded. Said hollow body is provided, in proximity to said first extremity, with means for engagement by a tool whereby a torque may be applied to said hollow body; a nut plate engageable with said inner frame and having an internal screw thread matching said externally screw-threaded portion of said hollow body, whereby said second extremity of said hollow body may be inserted into said nut plate and into an aperture in said inner frame and adjusted to project a desired distance outwards from said inner frame towards the outer frame to which said inner frame is to be attached.

An internal rotatable member, insertable in a hollow of said hollow body at said second extremity and projecting therefrom, is provided with engagement means for a tool insertable through said first extremity of said hollow body, whereby a torque may be applied to turn said internal rotatable member relative to said hollow body, and whereby an outer extremity of said internal rotatable member may thereby be brought into engagement with said outer frame.

Said connector units can be made of any suitable material, such as metal, plastic, or combinations thereof, although steel metal units are preferred.

In a preferred embodiment of said invention, there is provided a connector unit wherein said internal rotatable member is provided with an external screw thread and a matching, internal axial screw thread is provided in said hollow body, extending axially inwards from said second extremity, whereby a torque applied to turn said rotatable member relative to said hollow body effects an axial displacement of said rotatable member and the engagement of an outer extremity thereof with the outer frame.

In a most preferred embodiment of said invention, there is provided a window frame construction system comprising a plurality of connector units as described above; wherein said internal rotable member has a conical extremity whose point faces outwards away from said hollow body, an inner frame configured to hold a plurality of said hollow bodies and said nut plates at spaced-apart positions, and an outer frame connected to the building under construction, said outer frame being provided with apertures located to be engageable by the internal rotatable members of said connector units.

While the unit of the above mentioned patent has been found to fulfill its desired function in most contexts, occasionally, the inner and outer frames are so misaligned that said conical body cannot fully extend into the aperture provided in the outer frame. This results in weak interconnection between frames, and an inability to meet the requirements for withstanding high wind or blast forces.

Furthermore, said system requires the provision of apertures and the alignment of the connector units therewith.

In order to obviate this problem and to assure alignment between said inner and outer frames and secure engagement between said inner and outer frames there is now provided, according the present invention a window frame construction system for resisting blast forces comprising:

a) an inner frame;

b) an outer frame; and c) a plurality of aligning connector units for attaching said inner frame inside said outer frame, each of said connector units comprising, i) a hollow body attachable to said inner frame, said hollow body having a first extremity and an opposite, second extremity, at least a portion of the outer surface of said hollow body, including said first extremity, being eternally screw-threaded;

ii) a nut plate engageable with said inner frame and having an internal screw thread matching said externally screw-threaded portion of said hollow body, whereby said second extremity of said hollow body may be inserted into said nut plate and into an aperture in said inner frame and adjusted to project a desired distance outwards from said inner frame towards the outer frame to which said inner frame is to be attached; and iii) a first internal rotatable member, insertable in a hollow of said hollow body at said second extremity and projecting therefrom, provided with engagement means for a tool insertable through said first extremity of said hollow body, whereby a torque may be applied to turn said internal rotatable member relative to said hollow body, and wherein said first internal rotatable member is provided with a projection, an end portion of which faces outwards towards said outer frame for effecting engagement and alignment between said inner and outer frames, and whereby said projection of said internal rotatable member may thereby be brought into contact with said at least one abutment surface of said outer frame, and wherein a plurality of said abutment surfaces are positioned to be engageable by the projections of a plurality of said connector units;

characterized in that said outer frame is provided with at least one channel bounded by at least one abutment surface extending substantially at right angles from said outer frame towards said inner frame for engagement with said first internal rotatable member for alignment between said inner and outer frames and wherein each of said connector units is further provided with a second internal rotatable member, insertable in said hollow of said hollow body at said second extremity and projecting therefrom adjacent said first internal rotatable member, said second internal rotatable member being provided with a rod-like projection, positioned to enter an adjacent channel bounded by said abutment surface for effecting secure engagement between said inner and outer frames, the cross-sectional area of said rod being less than the cross-sectional area of the base of the conical extremity of said first rotatable member.

In a first preferred embodiment of the present invention said abutment surface is formed as a integral wall surface of said outer frame.

In a second preferred embodiment of the present invention said abutment surface is formed by a wall of a geometric body attached to a wall of said outer frame.

Thus, in an especially preferred embodiment, as described with reference to the drawings hereinafter, said abutment surface is formed by an arm of an inverted L-shaped flange attached to a wall of said outer frame, however said surface can also be formed by the side of an inverted U-shaped element attached to said wall of said outer frame, or even by the side of a right angle triangle In preferred embodiments of the present invention said abundant surface end a wall surface of said outer frame form two opposing sides of a channel into which said internal rotatable members are extended for alignment purposes.

It will be realized that the novel system of the present invention enables construction workers on site to quickly assemble inner frames within outer frames without distortion even when the outer frames are inaccurate and/or distorted, eliminates on-site drilling with all its attendant costs and dangers, and, through use of simply designed, modified outer frames, or the simple attachment of flange units to standard outer frames there is obtained a finished frame which resists high pressures, as specified for security rooms and for tall buildings wherein provision is made for exceptional wind pressures, without the need for forming apertures in said outer frame units.

In preferred embodiments of said invention said first internal rotatable member has a conical extremity with a bass of about 8–12 mm diameter and said second internal rotatable member is provided with a rod having a diameter of about 5–18 mm.

In French Patent 1517369 there is described a door having a frame assembly similar to that of the present invention however said patent does not teach or suggest a window frame construction system for resisting blast forces nor the utilization of a plurality of aligning connecting units having a first internal rotatable member for alignment between inner and outer frames and a second internal rotatable member for affecting secure engagement between said inner and outer frames. Furthermore as can clearly be seen from the Figures of said patent, the outer frame is provided with a channel bounded by an angled abutment surface as opposed to the outer frame of the present invention wherein the abutment surface extends substantially at right angles from said outer frame towards inner frame thereby better assuring secure interengaement to resist blast forces.

Similarly as stated hereinbefore while Israel Patent 116, 238 teaches a connector unit having a single internal rotatable member does not teach or suggest the utilization of a plurality of aligning connecting units having a first internal rotatable member for alignment between inner and outer frames and a second internal rotatable member for affecting secure engagement between said inner and outer frames.

The present factory prepared window frame construction system is also applicable to standard building construction and enables the ready use of blind frames therein according to the present invention.

The invention will now be described in connection with certain preferred embodiments with reference to the following illustrative figures so that it may be more fully understood.

With specific reference now to the figures in details, it is stressed that the particulars shown are by way of example and for purposes of illustrative discussion of the preferred embodiments of the present invention only, and am presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
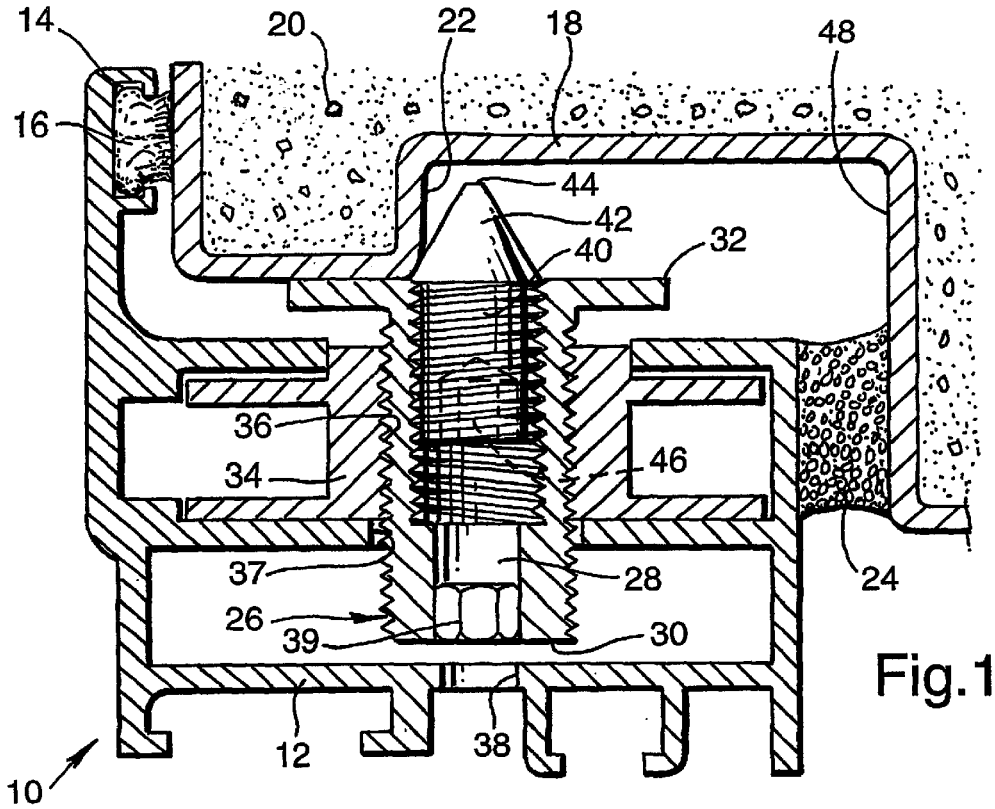
FIG. 1 is a sectional view of a preferred embodiment of the window frame construction according to the invention.
Figure 4:
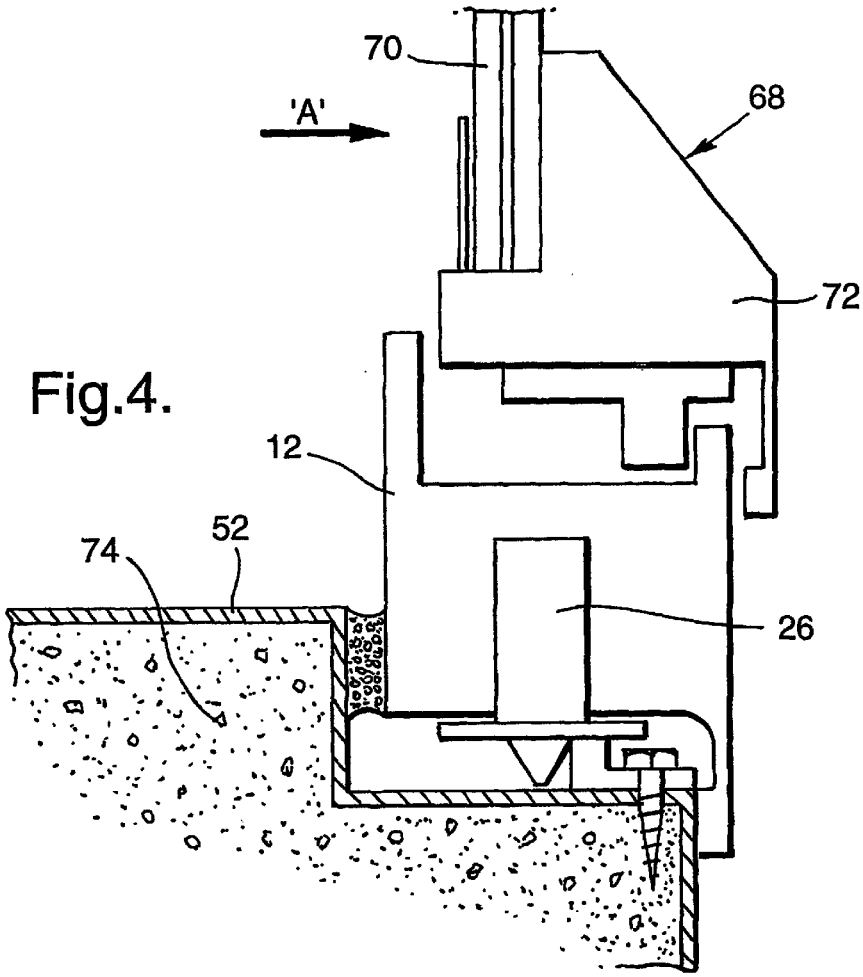
FIG. 4 is a non-detailed schematic view showing a window fitted into the inner frame.

There is seen in FIG. 1 a window frame construction system 10 as it appears before the window 68, seen in FIG. 4, is added.

An inner frame 12 having a complex shape is made of a metal extrusion. A channel 14 for supporting a flexible sealing strip 16 is provided so that the system can be sealed against both liquids and gases.

An outer frame 18 is attached during construction to the building concrete 20 usually by casting therearound. The outer frame 18 shown is suitably produced from a flat metal strip by cold roll forming or by a power press brake The outer frame 18 is provided with an abutment surface 22 projecting towards the inner frame 12. The two frames 12, 18 preferably make no direct contact with each other, thereby leaving space needed to allow for inaccuracies of manufacture. Such space is typically closed by a solidifying sealant 24 and by sealing strips 16.

A plurality of aligning connector units 26 are provided for attaching the inner frame 12 to the outer frame 18, and for transferring forces therebetween.

The unit 26 comprises a hollow body 28 which has a first extremity 30, and an opposite flanged second extremity 32. The outer surface of the hollow body 28, including the first extremity 30 are externally screw-threaded.

A nut plate 34 is engaged with the inner frame 12 and has at least one internal screw-thread 36 matching the externally screw-threaded portion of the hollow body 28. Thus the hollow body 28 may be screwed into the nut plate 34, while projecting into a suitable aperture 37 in the inner frame 12. On the building site the body 28 is adjusted to project towards and into contact with the outer frame 18 to which the inner frame 12 is to be attached. A small aperture 38 in the inner frame 12 allows access for a tool (not shown), such as a hexagonal wrench, for adjusting the projection of the body 28 using the socket 39.

A first internal rotatable member 40 is seen screwed into the hollow body 28 at its second extremity 32 and projecting therefrom. Internal member 40 has a conical extremity 42 with a point 44 facing outwards, for effecting alignment between the inner and outer frames 12, 18.

Preferably the inner member 40 is also provided with engagement means for a tool (not shown) insertable through the first extremity 30 of hollow body 28, so that a torque may be applied to turn and advance or retract rotatable member 40. In the embodiment shown engagement means is a hexagon socket 46 of the same size as is found in the hollow body 28. A hexagon wrench with a cylindrical shank can then be used as a tool capable of turning either part 28, 40. Thus the outer extremity 42 of the member 40 may be brought into contact with abutment surface 22 of the outer frame 18.

Figure 2:
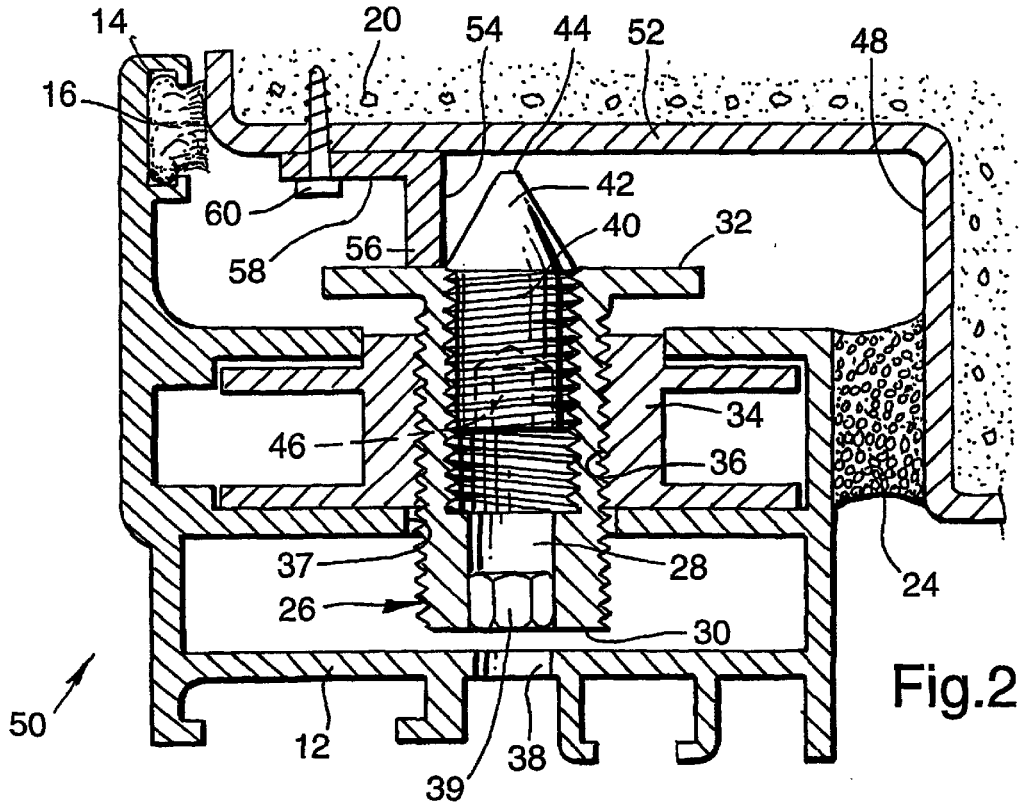
FIG. 2 is a sectional view of an embodiment of the window frame construction showing an added on abutment surface.

Cost reduction is effected when the abutment surface 22 is formed as an integral wall surface of the outer frame 18 as shown in the present embodiment. FIG. 2 will show a solution applicable where the outer frame does not have an abutment surface available, as could be the case when the system of the present invention is to be used with a prior-art outer frame. In any case, there is no need to cut an aperture on site for purposes of abutment.

The abutment surface 22 and a wall surface 48 of the outer frame 18 form two opposing sides of a channel into which the internal rotatable members 40 are extended for alignment purposes of the two frames 12, 18.

While FIG. 1 shows only a single aligning connector unit 26, it will of course be understood that in a practical window the abutment surface 22 is extended around the frame 18 and is positioned to be engageable by the internal rotatable members 40 of a plurality of connector units 26.

With regard to the rest of the figures, similar reference numerals have been used to identify similar parts.

Referring now to FIG. 2, there is seen a window frame construction system 50 which is suitable for use in combination with a prior art outer frame 52. Such frame may not have an abutment surface, so the present embodiment illustrates how such a surface may be added. The abutment surface 54 is formed by an arm 56 of an inverted L-shaped flange 58 rigidly attached to a wall of the outer frame 52. In the figure, attachment is shown to be by means of screws 60. However any other convenient attachment method can be used—for example spot welding or riveting if attachment is effected before the frame 52 is attached to the building, or electric arc welding if the L-shaped flange 58 must be attached on site.

Figure 3:
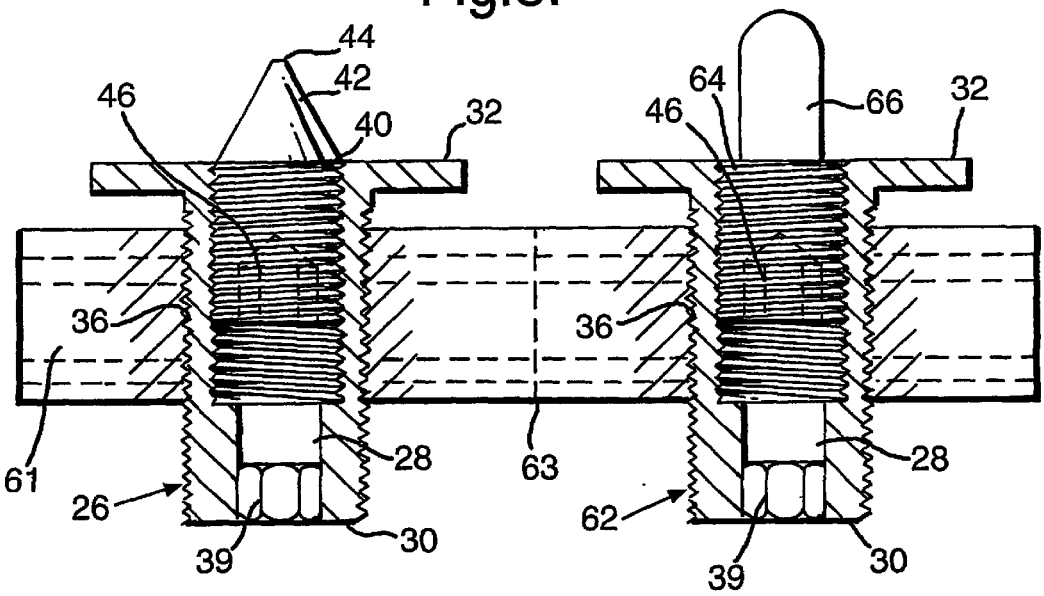
FIG. 3 is a sectional view of a nut plate supporting two connector units.

FIG. 3 illustrates a detail of a window frame construction system wherein the nut plate 61 is further provided with a second connector unit 62 having a second type of internal rotatable member 64 inserted in the hollow body 28. The member 64 projects therefrom adjacent the first internal rotatable member 40.

Several short nut plates can be used each having a single internal screw-thread matching the externally screw-threaded portion of the hollow body. In the shown embodiment the nut plate 61 is long and has two or more spaced-apart internal screw-threads 36.

The second internal rotatable member 64 is provided with a rod-like projection 66 positioned to also engage the abutment surface 22, seen in FIG. 1, and for effecting secure engagement between said inner and outer frames 12, 18. The cross-sectional area of the rod-like projection 66 is less than the cross-sectional area of the base of the conical extremity 42 of the first rotatable member 40.

Each rotatable member has its function. The conical member 40 is used for purposes of alignment. The rod-like projection 66 is however better able to resist blast forces, as unlike the conical member, all force to which it is subjected is transmitted to the abutment surface 22 seen in FIG. 1 in a direction perpendicular to the plane of the window glass seen in FIG. 4. No part of the force is translated into the plane of the window glass or parallel thereto.

Preferably the first internal rotatable member 40 has a conical extremity 42 with a base of about 8–12 mm diameter and the second internal rotatable member 64 is provided with a rod-like projection 66 having a diameter of about 5–8 mm.

Units 62 and 26 can be part of a single combined connector unit formed in a single nut plate 61 as shown or said units could be provided separately as indicated by broken line 63.

Seen in FIG. 4 in non-detailed form is an outer frame 52, an inner frame 12 and a framed openable window 68. The arrow 'A' shows the direction of an expected pressure wave which is resisted by the window 68. Blast force is transferred from the window glass 70 to the window frame 72, from the window frame 72 to the inner frame 12, and from the inner frame 12 to the outer frame 52 via a plurality of aligning connector units 26. The outer frame 52 transfers the force to the wall of the building 74, which for this type of service is typically made of reinforced concrete.

It will be evident to those skilled in the art that the invention is not limited to the details of the foregoing illustrative examples and that the present invention may be embodied in other specific forms without departing from the essential attributes thereof, and it is therefore desired that the present embodiments and examples be considered in all respects as illustrative and not restrictive, reference being made to the appended claims, rather than to the foregoing description, and all changes which come within the meaning and range of equivalency of the claims are therefore intended to be embraced therein.

What is claimed is:

1. A window frame construction system for resisting blast forces comprising;

a) an inner frame;

b) an outer frame; and c) a plurality of aligning connector units for attaching said inner frame inside said outer frame, each of said connector units comprising;

i) a hollow body attachable to said inner frame, said hollow body having a first extremity and an opposite, second extremity, at least a portion of the outer surface of said hollow body, including said first extremity, being externally screw-threaded;

ii) a nut plate engageable with said inner frame and having an internal screw thread matching said externally screw-threaded portion of said hollow body, whereby said second extremity of said hollow body may be inserted into said nut plate and into an aperture in said inner frame and adjusted to project a desired distance outwards from said inner frame towards the outer frame to which said inner frame is to be attached; and iii) a first internal rotatable member, insertable in a hollow of said hollow body at said second extremity and projecting therefrom, provided with engagement means for a tool insertable through said first extremity of said hollow body, whereby a torque may be applied to turn said internal rotatable member relative to said hollow body, and wherein said first internal rotatable member is provided with a projection, an end portion of which faces outwards towards said outer frame for effecting engagement and alignment between said inner and outer frames, and whereby said projection of said internal rotatable member may thereby be brought into contact with said at least one abutment surface of said outer frame, and wherein and plurality of said abutment surfaces are positioned to be engagable by the projections of a plurality of said connector units;

characterized in that said outer frame is provided with at least one channel bounded by at least one abutment surface extending substantially at right angles from said outer frame towards said inner frame for engagement with said first internal rotatable member for alignment between said inner and outer frames and wherein each of said connector units is further provided with a second internal rotatable member, insertable in said hollow of said hollow body at said second extremity and projecting therefrom adjacent said first internal rotatable member, said second internal rotatable member being provided with a rod-like projection, positioned to enter an adjacent channel bounded by said abutment surface for effecting secure engagement between said inner and outer frames, the cross-sectional area of said rod being less than the cross-sectional area of the base of the conical extremity of said first rotatable member.

2. A window frame construction system according to claim 1, wherein said first internal rotatable member has a conical extremity with a point facing outwards for effecting alignment between said inner and outer frames.

3. A window frame construction system according to claim 1, wherein said abutment surface is formed as a integral wall surface of said outer frame.

4. A window frame construction system according to claim 1, wherein said abutment surface is formed by a wall of a geometric body attached to a wall of said outer frame.

5. A window frame construction system according to claim 4, wherein said abutment surface is formed by an arm of an inverted L-shaped flange attached to a wall of said outer frame.

6. A window frame construction system according to claim 1, wherein said abutment surface and a wall surface of said outer frame form two opposing sides of a channel into which said internal rotable members are extended for alignment purposes.

7. A window frame construction system according to claim 1, wherein said first internal rotatable member has a conical extremity with a base of about 8–12 mm diameter and said second internal rotatable member is provided with a rod having a diameter of about 5–8 mm.

* * * * *

UNITED STATES PATENT AND TRADEMARK OFFICE

CERTIFICATE OF CORRECTION

PATENT NO. : 6,874,286 B2
DATED : April 5, 2005
INVENTOR(S) : Aharon Tavivian

It is certified that error appears in the above-identified patent and that said Letters Patent is hereby corrected as shown below:

Title page,
Item [63], Foreign Application Priority Data, "Mar. 7, 2001 (IL)……134931", should be replaced with -- Mar. 7, 2000 (IL)…..134931 --.

Signed and Sealed this

Sixth Day of September, 2005

JON W. DUDAS
*Director of the United States Patent and Trademark Office*